US005748160A

United States Patent [19]

Shieh et al.

[11] Patent Number: 5,748,160

[45] Date of Patent: May 5, 1998

[54] ACTIVE DRIVEN LED MATRICES

[75] Inventors: Chan-Long Shieh, Paradise Valley, Ariz.; Hsing-Chung Lee, Calabasas, Calif.; Franky So, Tempe, Ariz.

[73] Assignee: Mororola, Inc., Schaumburg, Ill.

[21] Appl. No.: 517,222

[22] Filed: Aug. 21, 1995

[51] Int. Cl.[6] ..... G09G 3/32

[52] U.S. Cl. ..... 345/82; 345/147; 345/210

[58] Field of Search ..... 345/82, 83, 39, 345/63, 147, 210, 211, 208

[56] References Cited

U.S. PATENT DOCUMENTS

| | | | |
|---|---|---|---|
| 4,488,150 | 12/1984 | Kanatani | 345/77 |
| 4,554,539 | 11/1985 | Graves | 345/211 |
| 4,967,192 | 10/1990 | Hirane et al. | 345/211 |
| 5,184,114 | 2/1993 | Brown | 345/83 |
| 5,198,803 | 3/1993 | Shie et al. | 345/82 |

*Primary Examiner*—Richard Hjerpe
*Assistant Examiner*—Xu-Ming Wu
*Attorney, Agent, or Firm*—Eugene A. Parsons

[57] ABSTRACT

A matrix of light emitting devices including a voltage source constructed to repetitiously supply a multi-step voltage waveform and a matrix of rows and columns of pixels, each pixel being connected to the voltage source. A method of driving the matrix including addressing each of the pixels of the matrix by supplying scan and image data activating signals to each of the pixels, the image data activating signal being used to activate a pixel by completing a current path from the pixel to a return for the voltage source, and activating the voltage source to repetitiously supply multi-step waveforms of voltage and sequentially supply each step of each of the multi-step voltage waveforms to the pixels, and addressing each of the pixels in the matrix for each step supplied.

17 Claims, 2 Drawing Sheets

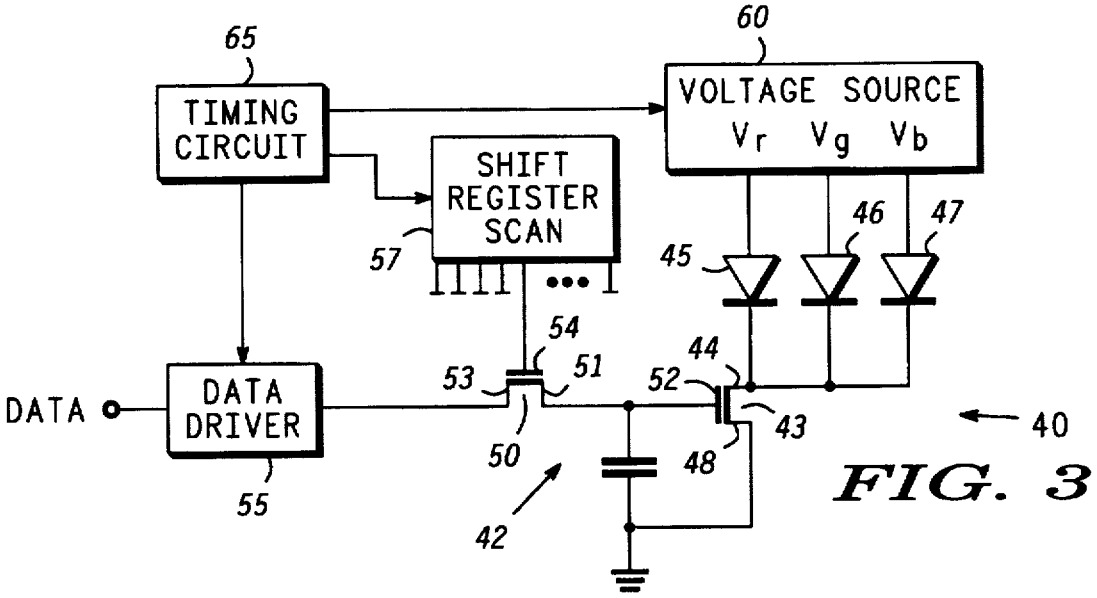
FIG. 3
FIG. 4
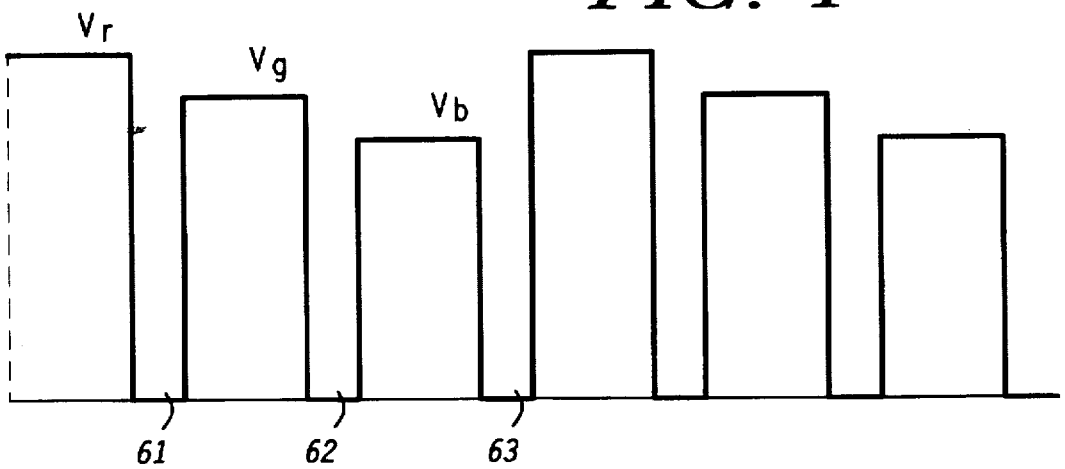
FIG. 5
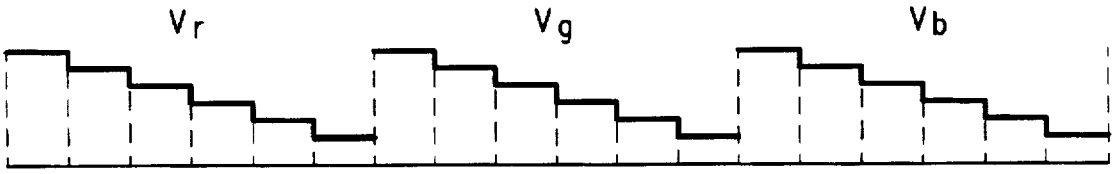

ACTIVE DRIVEN LED MATRICES

FIELD OF THE INVENTION

The present invention pertains to active matrices and more specifically to new apparatus and methods of driving active matrices.

BACKGROUND OF THE INVENTION

Displays utilizing two dimensional arrays, or matrices, of pixels each containing one or more light emitting devices are very popular in the electronics field and especially in portable electronic and communication devices, because large amounts of data and pictures can be transmitted very rapidly and to virtually any location. One problem with these matrices is that each row (or column) of light emitting devices in the matrix must be separately addressed and driven with a video or data driver.

Generally, in non-color type displays (black and white) each pixel contains a single light emitting device which must be driven in a range of values to achieve a range of gray (gray scale) between full on (white) and full off (black). In order to get good gray scale, the data drivers generally have to be able to deliver an accurate analog voltage to each pixel. However, analog driver circuits are very expensive and, since there must be hundreds of data drivers (one for each row of light emitting devices), are the major part of the display cost.

Further, in full color displays, each pixel contains at least three light emitting devices, each of which produces a different color (e.g. red, green and blue) and each of which must be driven (generally a row at a time) in a range of values to achieve a range of that specific color between full on and full off. Thus, full color displays contain three times as many analog drivers, which triples the manufacturing cost of the display. Also, the additional analog drivers require additional space and power, which can be a problem in portable electronic devices, such as pagers, cellular and regular telephones, radios, data banks, etc.

Accordingly, it would be advantageous to be able to manufacture displays, and especially color displays, with simpler and fewer data drivers.

It is a purpose of the present invention to provide new and improved active driven matrices of light emitting device.

It is another purpose of the present invention to provide new and improved active driven matrices of light emitting device using digital data drivers.

It is still another purpose of the present invention to provide new and improved active driven matrices of light emitting device for color displays utilizing fewer data drivers.

It is a further purpose of the present invention to provide less expensive and smaller displays.

It is a still further purpose of the present invention to provide organic light emitting diode displays which are less expensive, smaller and easier to manufacture.

SUMMARY OF THE INVENTION

The above problems and others are at least partially solved and the above purposes and others are realized in a matrix of light emitting devices including a voltage source constructed to repetitiously supply a multi-step voltage waveform and a matrix of rows and columns of pixels, each pixel being connected to the voltage source and a method of driving the matrix including addressing each of the pixels of the matrix by supplying scan and image data activating signals to each of the pixels, the image data activating signal being used to activate a pixel by completing a current path from the pixel to a return for the voltage source, and activating the voltage source to repetitiously supply multi-step waveforms of voltage and sequentially supply each step of each of the multi-step voltage waveforms to the pixels, and addressing each of the pixels in the matrix for each step supplied.

In another embodiment, which might be used, for example, in full or partial colored displays, the voltage source has a plurality of outputs and is constructed to repetitiously supply a multi-step voltage waveform sequentially on each of the outputs. Also, each pixel includes at least a first light emitting device having a first contact connected to a first output of the plurality of outputs and a second light emitting device having a first contact connected to a second output of the plurality of outputs of the voltage source. The voltage source is activated to supply a multi-step waveform of voltage to the first output of the plurality of outputs of the voltage source and each of the pixels in the matrix is addressed for each step of the multi-step voltage waveform, the voltage source is further activated to supply a multi-step waveform of voltage to the second output of the plurality of outputs and each of the pixels in the matrix is addressed for each step of the multi-step voltage waveform, and the voltage source is further activated for each additional output of the plurality of outputs. If, for example, the first light emitting device in each pixel is red, the second is green and a third is blue, full color is available from the matrix.

BRIEF DESCRIPTION OF THE DRAWINGS

Referring to the drawings:

FIG. 3 illustrates a block/schematic diagram of another active driven LED matrix embodying the present invention; and FIGS. 4 and 5 illustrate voltage waveforms of the structure of FIG. 3.

DESCRIPTION OF THE PREFERRED EMBODIMENTS

Figure 1:
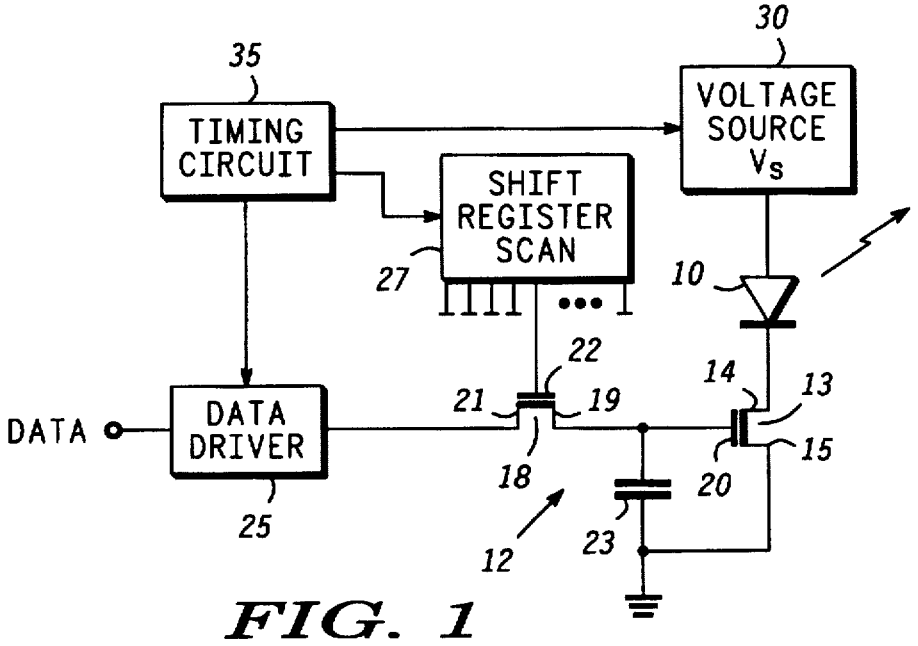
FIG. 1 illustrates a block/schematic diagram of an active driven LED matrix embodying the present invention.

Referring now to FIG. 1, a simplified block/schematic drawing is illustrated showing an active driven light emitting diode matrix. For simplicity of this description, a single light emitting diode 10 is illustrated but it will be understood that diode 10 is simply one diode in a two dimensional array including rows and columns of light emitting diodes. Further, light emitting diode 10, and each other diode in the matrix has a semiconductor switch 12 attached thereto, making the matrix an active matrix. In this specific embodiment switch 12 includes a first transistor 13 having a current carrying electrode 14 connected to the cathode of diode 10 and a current carrying electrode 15 connected to a common return, such as ground or the like. Switch 12 further includes a second transistor 18 having a current carrying terminal 19 connected to a gate or control terminal 20 of transistor 13. A second current carrying terminal 21 of transistor 18 serves as a data input and a gate or control terminal 22 serves as an input for scan signals. A capacitor 23 is connected between control terminal 20 and the common return or ground as a storage element to maintain diode 10 in an ON mode for a specific period of time after switching. In this specific embodiment light emitting diode 10 and switch 12 form a pixel.

In this preferred embodiment, light emitting diode 10 is an organic light emitting diode, which is a current driven device, so that switch 12 is a low operating voltage device. Light emitting diode 10 is addressed by supplying a scan signal to control terminal 22 of transistor 18 and a data signal to current terminal 21. Depending upon the data signal, when transistor 13 is activated a current path is completed between the cathode of light emitting diode 10 and the common return, or ground. Each current carrying terminal 21 for each switch 12 in each pixel in a column are connected together and to a data driver 25. While transistors 13 and 18 are illustrated as n-type devices, it will be understood by those skilled in the art that diodes 10 could be reversed and p-type devices could be used in switch 12, if desired.

As an example, in a typical matrix there may be 640 columns by 480 rows of pixels. Thus, there are 640 data drivers 25. It will of course be understood that the matrix could be rotated ninety degrees so that the scan signals and data signals are supplied to columns and rows, respectively, if desired. Further, data drivers 25 are relatively simple digital drivers in this embodiment, for reasons that will become apparent presently. Data is supplied to a data input of each data driver 25, which data may be, for example, received from a wireless communication or from some data bank or storage device and may represent alpha-numeric and/or graphic information.

Control terminal 22 of each switch 12 in a row of pixels are connected together and to a circuit for supplying scan signals thereto. In the structure of FIG. 1, for purposes of this explanation, a shift register 27 is provided to supply the scan signals. Shift register 27 has a separate output for each row in the matrix (e.g. 480 outputs) and sequentially supplies a scan signal on each output in turn. Thus rows 1 through 480 of the matrix are sequentially supplied with a scan signal. As is understood in the art, a scan signal is applied to each row for a sufficient time to allow all of the data drivers to be activated so that each pixel in the row being scanned is addressed. A scan signal is then applied to the next row and all of the data drivers are activated, etc. Therefore, each pixel in the matrix is addressed with a scan and data signal by the combination of data drivers 25 and shift register 27.

Figure 2:
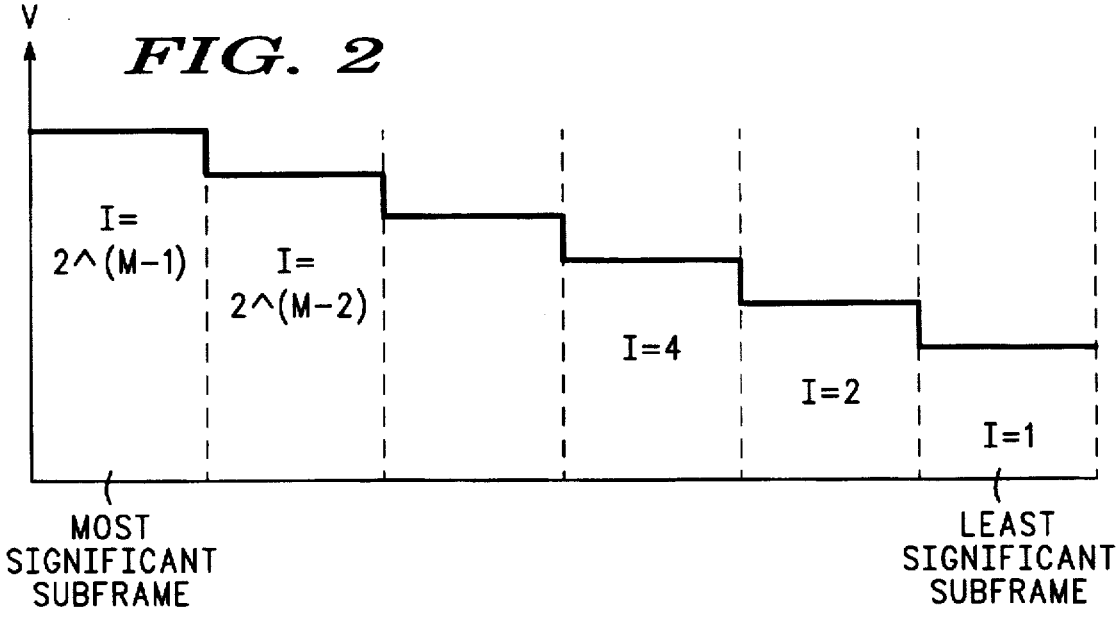
FIG. 2 illustrates a voltage waveform of the structure of FIG. 1.

A voltage source 30 is provided which is constructed to repetitiously supply a multi-step voltage waveform at an output thereof. A typical multi-step voltage waveform is illustrated in FIG. 2, including m ascending steps, or subframes, and each step represents the amount of voltage required to produce the intensity, I, produced by a specific light emitting diode (e.g. diode 10). All of the anodes of the light emitting diodes are connected together and to the output terminal of voltage source 30. In the operation, a first step of voltage (e.g. I=1) is applied to the output terminal (all of the anodes of the diodes) and the entire matrix is addressed to complete a first subframe. The data from data drivers 25 includes a digital signal that turns ON each pixel (completes a circuit from the cathode of the diode to ground) that requires a first level or shade of gray. A second step of voltage (e.g. T=2) is applied to the output terminal (all of the anodes of the diodes) and the entire matrix is addressed to complete a second subframe. This procedure is continued until all m of the subframes are completed, completing a frame.

A timing circuit 35 is attached to data drivers 25, shift register 27 and voltage source 30 to ensure proper synchronization of the subframes and frames. Also, in instances where the data is communicated through a wireless communication system (e.g. radio, cellular telephone, etc.) timing circuit 35 is synchronized to the incoming data. Thus, by subdividing a frame into m subframes and properly synchronizing voltage source 30 to the scan and data drivers, an m-bit gray scale is achieved using simple digital data drivers.

Referring now to FIG. 3, a simplified block/schematic diagram is illustrated showing another embodiment of an active driven light emitting diode matrix, which is utilized to produce full color images. For simplicity of this description, a single pixel 40 is illustrated but it will be understood that pixel 40 is simply one pixel in a two dimensional array or matrix including rows and columns of pixels. Pixel 40, and each other pixel in the matrix, has a semiconductor switch 42 attached thereto, making the matrix an active matrix.

In this specific embodiment switch 42 includes a first transistor 43 having a current carrying electrode 44 connected in common to the cathodes of three light emitting diodes 45, 46, and 47 and a current carrying electrode 48 connected to a common return, such as ground or the like. Switch 42 further includes a second transistor 50 having a current carrying terminal 51 connected to a gate or control terminal 52 of transistor 43. A second current carrying terminal 53 of transistor 50 serves as a data input and a gate or control terminal 54 serves as an input for scan signals. In this specific embodiment, light emitting diodes 45, 46, and 47 and switch 42 form a pixel. While transistors 43 and 50 are illustrated as n-type devices, it will be understood by those skilled in the art that diodes 45, 46, and 47 could be reversed and p-type devices could be used in switch 42, if desired.

In this preferred embodiment, light emitting diodes 45, 46, and 47 are organic light emitting diodes designed to produce red, green and blue light, respectively, when energized. Pixel 40 is addressed by supplying a scan signal to control terminal 54 of transistor 50 and a data signal to current terminal 53. Depending upon the data signal, when transistor 43 is activated a current path is completed between all three cathodes of light emitting diodes 45, 46, and 47 and the common return, or ground. Each current carrying terminal 53 for each switch 42 in each pixel in a column are connected together and to a data driver 55. As an example, in a typical matrix containing 640 columns by 480 rows of pixels, there are 640 data drivers 55. Data is supplied to a data input of each data driver 55, which data may be, for example, received from a wireless communication or from some data bank or storage device and may represent alphanumeric and/or graphic information.

Control terminal 54 of each switch 42 in a row of pixels are connected together and to a circuit for supplying scan signals thereto. In the structure of FIG. 3, for purposes of this explanation, a shift register 57 is provided to supply the scan signals. Shift register 57 has a separate output for each row in the matrix (e.g. 480 outputs) and sequentially supplies a scan signal on each output in turn. Thus rows 1 through 480 of the matrix are sequentially supplied with a scan signal. As is understood in the art, a scan signal is applied to each row for a sufficient time to allow all of the data drivers to be activated so that each pixel in the row being scanned is addressed. A scan signal is then applied to the next row and all of the data drivers are activated, etc. Therefore, each pixel in the matrix is addressed by the combination of data drivers 55 and shift register 57.

A voltage source 60 is provided which is constructed to repetitiously supply voltage to each of three outputs, designated Vr, Vg, and Vb, as illustrated in FIG. 4. The anodes of the light emitting diodes 45 in all of the pixels in the matrix (e.g. 480×640=307,200) are connected together and to output terminal Vr of voltage source 60. The anodes of the light emitting diodes 46 in all of the pixels in the matrix are connected together and to output terminal Vg of voltage source 60. The anodes of the light emitting diodes 47 in all of the pixels in the matrix are connected together and to output terminal Vb of voltage source 60.

In the operation, a first voltage is applied to the output terminal Vr and the entire matrix is addressed to complete a first subframe. Generally, the entire matrix (all pixels) can be addressed in several well known addressing schemes, for example, be sequencing through the rows, one through n, and supplying data to all of the columns simultaneously in parallel as each row is addressed. Whatever addressing scheme is used, the result is to provide each pixel in the array with a scan and a data signal. In this specific embodiment, data drivers 55 are analog drivers that turn switches 42 on for a predetermined amplitude or time of current flow through one of diodes 45, 46, or 47 to achieve the amount of each color desired in each pixel. A second voltage Vg is applied to the output terminal Vg and the entire matrix is addressed to complete a second subframe. A third voltage Vb is applied to the output terminal Vb and the entire matrix is addressed to complete a third subframe. The three subframes form a complete frame and the procedure is repeated at a rate of approximately 60 frames per second.

Referring again to FIG. 4, each of the voltages Vr, Vg, and Vb has associated therewith a blanking pulse 61, 62, and 63, respectively. The blanking pulses are provided before each subframe to allow for the transfer of data into the storage capacitor. Thus, the next subframe begins with a proper value of data in the storage capacitor when the diode is turned on. In some embodiments (e.g. those of FIGS. 2 and 5) it may be desirable to provide blanking pulses between each subframe and sub-subframe and, in some applications the blanking pulses may actually include a reverse bias (a negative voltage) to improve the reliability of the diode and especially organic light emitting diodes. The negative voltage ensures the complete removal of any charge build-up that may occur in the various circuits.

A timing circuit 65 is attached to data drivers 55, shift register 57 and voltage source 60 to ensure proper synchronization of the subframes and frames. Also, in instances where the data is communicated through a wireless communication system (e.g. radio, cellular telephone, etc.) timing circuit 65 is synchronized to the incoming data. Thus, by subdividing a frame into a plurality of subframes equal to the number of colors being used and properly synchronizing voltage source 60 to the scan and data drivers, a color image is achieved. It will of course be understood that diodes which generate light of two different colors can be used for generating colored images which are less than full color. Also, in some applications it may be desirable for different portions of an image to be a different color.

Thus, while a more complicated analog driver is used in this embodiment, the number of active matrix elements (i.e. two FETs and a capacitor) and the number of data drivers is reduced by a factor of three for a full color display. This is a substantial reduction in the size and cost of the matrix and the cost of the drivers.

Referring to FIG. 5, a multi-step voltage waveform is illustrated for a different embodiment of an active driven light emitting diode matrix in accordance with the present invention. The waveform of FIG. 5 will be explained in conjunction with the structure of FIG. 3, which again is utilized to produce full color images. In this modified embodiment, data drivers 55 are relatively simple digital drivers, rather than the previously described analog drivers, for reasons that will be apparent presently.

In the multi-step voltage waveform of FIG. 5, one complete frame is illustrated. Each frame is divided into three subframes Vr, Vg, and Vb and each subframe is divided into m multi-steps of voltage or sub-subframes. As described previously, the multi-step subframe Vr is applied to the Vr output of voltage source 60 and the entire matrix is addressed for each of the m steps. This procedure is continued until all m of the sub-subframes are completed, completing a subframe. Voltage source 60 is then switched so that the multi-step subframe Vg is applied to the Vg output. The entire matrix is again addressed for each of the m steps and the procedure is continued until all m of the sub-subframes are completed, completing a second subframe. When the second subframe is completed, voltage source 60 is switched so that the multi-step subframe Vb is applied to the Vb output. The entire matrix is again addressed for each of the m steps and the procedure is continued until all m of the sub-subframes are completed, completing a third subframe. The entire procedure is then repeated.

Because the multi-step voltage waveforms provide different intensities of each of the various colors, the data drivers, in this embodiment, are simple digital drivers used to turn on switch 42 for a specific time. Thus, the number of active matrix elements (i.e. two FETs and a capacitor) and the number of data drivers is reduced by a factor of three for a full color display and, in addition, the data drivers are greatly simplified. This is a substantial reduction in the cost and number of the data drivers and in the size and cost of the matrix.

Accordingly, displays, and especially color displays, with simpler and/or fewer data drivers have been disclosed. In particular, relatively simple digital drivers can be used instead of much more complicated and expensive analog drivers, to greatly reduce the cost of displays. In addition, the disclosed displays incorporate fewer components in the active matrix so that not only are the data drivers reduced in number and simplified but the matrix is also simplified. Further, because the active components in a matrix for a full color display are reduced by one third, the matrix is easier to manufacture and can be made smaller.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. Active drive apparatus for a matrix of light emitting devices comprising:

a voltage source constructed to repetitiously supply a multi-step voltage waveform when activated;

a matrix including a plurality of rows of light emitting devices and a plurality of columns of light emitting devices, each light emitting device having a first contact connected to the voltage source and a second contact;

a plurality of semiconductor switches, one each associated with each light emitting device, each semiconductor switch having a first current carrying terminal connected to the second contact of the associated light emitting device and a second current carrying terminal connected to a common terminal, each semiconductor switch further having first and second activating input terminals, and each semiconductor switch being constructed to complete a circuit between the first and second current carrying terminals only when activating signals are supplied to both of the first and second activating input terminals; and a column driver circuit having a plurality of column outputs one each associated with each column of light emitting devices, all of the first activating terminals of each semiconductor switch associated with the light emitting devices in each specific column of light emitting devices being connected together and to the associated column output of the plurality of column outputs;

a row driver circuit having an output all of the second activating terminals of each semiconductor switch associated with the light emitting devices in each specific row of light emitting devices being connected together and to the output of the row driver circuit:

timing circuitry connected to the voltage source, the column driver circuit and the row driver circuit, the timing circuit being constructed to control the row driver circuit to provide an activating signal to each row in sequence and to control the column driver circuit to provide an activating signal to each column for each activating signal applied to a row, each activation or addressing of all of the light emitting devices in the matrix being a sub-frame; and the timing circuit being further constructed to control the column and row driver circuits and the voltage source and to supply a next sequential step of the multi-step voltage waveform each time a sub-frame is completed, a frame being completed when all of the multi-step voltages of the waveform are supplied.

2. Active drive apparatus for a matrix of light emitting devices as claimed in claim 1 wherein the multi-step voltage waveform which the voltage source is constructed to repetitiously supply includes a plurality of ascending steps of voltage, each representing a level of a multi-bit gray scale.

3. Active drive apparatus for a matrix of light emitting devices as claimed in claim 1 wherein the light emitting devices are current driven devices.

4. Active drive apparatus for a matrix of light emitting devices as claimed in claim 3 wherein the light emitting devices are organic light emitting diodes.

5. Active drive apparatus for a matrix of light emitting devices as claimed in claim 1 wherein each of the plurality of semiconductor switches includes a first transistor with current carrying electrodes forming the first and second current carrying terminals of the semiconductor switch, and a control electrode.

6. Active drive apparatus for a matrix of light emitting devices as claimed in claim 5 wherein each of the plurality of semiconductor switches further includes a second transistor with a first current carrying electrode connected to the control electrode of the first transistor, a second current carrying electrode forming the first activating input terminal of the semiconductor switch, and a control terminal forming the second activating input terminal of the semiconductor switch.

7. Active drive apparatus for a matrix of light emitting devices as claimed in claim 1 wherein each of the column driver circuits is a digital driver.

8. Active drive apparatus for a matrix of light emitting devices as claimed in claim 1 wherein all of the second activating terminals of each semiconductor switch associated with the light emitting devices in each specific row of light emitting devices are connected together and to an output of a shift register.

9. Active drive apparatus for a matrix of light emitting devices comprising:

a voltage source having a plurality of outputs and constructed to repetitiously supply a multi-step voltage waveform sequentially on each of the outputs when activated;

a matrix including a plurality of rows of pixels and a plurality of columns of pixels, each pixel including a plurality of light emitting devices with a first light emitting device of the plurality of light emitting devices having a first contact connected to a first output of the plurality of outputs of the voltage source and a second light emitting device of the plurality of light emitting devices having a first contact connected to a second output of the plurality of outputs of the voltage source, and the first and second light emitting devices of each pixel each having a second contact; and a plurality of semiconductor switches, one each associated with each pixel, each semiconductor switch having a first current carrying terminal connected to the second contacts of each of the first and second light emitting devices of the associated pixel and a second current carrying terminal connected to a common terminal, each semiconductor switch further having first and second activating input terminals, and each semiconductor switch being constructed to complete a circuit between the first and second current carrying terminals only when activating signals are supplied to both of the first and second activating input terminals.

10. Active drive apparatus for a matrix of light emitting devices as claimed in claim 9 wherein each of the light emitting devices in each pixel are constructed to produce a different color of light.

11. Active drive apparatus for a matrix of light emitting devices as claimed in claim 9 wherein each of the pixels includes three light emitting devices, each constructed to produce a different color of light.

12. Active drive apparatus for a matrix of light emitting devices as claimed in claim 11 wherein the three light emitting devices of each pixel are constructed to produce red, green and blue color light, respectively.

13. Active drive apparatus for a matrix of light emitting devices as claimed in claim 9 wherein all of the second activating terminals of each semiconductor switch associated with the pixels in each specific row of pixels are connected together and to an output of a shift register.

14. Active drive apparatus for a matrix of light emitting devices as claimed in claim 13 including in addition timing circuitry connected to the voltage source, the column driver circuits and the shift register, the timing circuit being constructed to switch the voltage source to the first output of the plurality of outputs of the voltage source and to control the shift register to provide an activating signal to each row in sequence and to control each column driver circuit to provide an activating signal to each column in sequence for each activating signal applied to a row while the voltage source is supplying a multi-step voltage waveform sequentially on the first output and to switch the voltage source to the second output of the plurality of outputs of the voltage source and to control the shift register to provide an activating signal to each row in sequence and to control each column driver circuit to provide an activating signal to each column in sequence for each activating signal applied to a row while the voltage source is supplying a multi-step voltage waveform sequentially on the second output, each activation of all of the first light emitting devices in the matrix being a first sub-sub-frame of a sub-frame, each activation of all of the second light emitting devices in the matrix being a second sub-sub-frame of a sub-frame, and each activation of all of the pixels in the matrix being a sub-frame.

15. Active drive apparatus for a matrix of light emitting devices as claimed in claim 14 wherein the timing circuit is constructed to control the voltage source to supply a next sequential step of the multi-step voltage waveform each time a sub-frame is completed, a frame being completed when all of the multi-step voltages of the waveform are supplied to all of the outputs of the plurality of outputs of the voltage source.

16. A method of driving a matrix of light emitting devices comprising the steps of:

providing a voltage source constructed to repetitiously supply a multi-step voltage waveform when activated;

providing a matrix including a plurality of rows of pixels and a plurality of columns of pixels, each pixel having a first contact connected to the voltage source and a second contact;

addressing each of the pixels of the matrix by supplying scan and image data activating signals to each of the pixels of the matrix, the image data activating signal being used to determine when a pixel is activated by completing a current path from the second contact of each pixel to a return for the voltage source; and activating the voltage source to repetitiously supply multi-step waveforms of voltage and sequentially supply each step of each of the multi-step voltage waveforms to the pixels, and addressing each of the pixels in the matrix for each step supplied.

17. A method of driving a matrix of light emitting devices comprising the steps of:

providing a voltage source having a plurality of outputs and constructed to repetitiously supply a multi-step voltage waveform sequentially on each of the outputs when activated;

providing a matrix including a plurality of rows of pixels and a plurality of columns of pixels, each pixel including a plurality of light emitting devices with a first light emitting device of the plurality of light emitting devices having a first contact connected to a first output of the plurality of outputs of the voltage source and a second light emitting device of the plurality of light emitting devices having a first contact connected to a second output of the plurality of outputs of the voltage source, and the first and second light emitting devices of each pixel each having a second contact connected to a common terminal;

addressing each of the pixels of the matrix by supplying scan and image data activating signals to each of the pixels of the matrix, the image data activating signal being used to determine when a pixel is activated by completing a current path from the common terminal to a return for the voltage source;

activating the voltage source to supply a multi-step waveform of voltage to the first output of the plurality of outputs of the voltage source and addressing each of the pixels in the matrix for each step of the multi-step voltage waveform; and activating the voltage source to supply a multi-step waveform of voltage to the second output of the plurality of outputs of the voltage source and addressing each of the pixels in the matrix for each step of the multi-step voltage waveform.

* * * * *